US005105909A

United States Patent [19]

Leonards

[11] Patent Number: 5,105,909

[45] Date of Patent: Apr. 21, 1992

[54] HAZARDOUS ELEVATED STRUCTURE EMERGENCY ESCAPE DEVICE

[76] Inventor: Leo J. Leonards, 804 Yvette Marie Dr., Lafayette, La. 70508

[21] Appl. No.: 621,753

[22] Filed: Dec. 3, 1990

[51] Int. Cl.[5] ..... A62B 1/20

[52] U.S. Cl. ..... 182/100; 182/190

[58] Field of Search ..... 182/100, 70, 190, 189

[56] References Cited

U.S. PATENT DOCUMENTS 442,961 12/1890 Dixon ..... 182/100
645,415 7/1900 Rinn ..... 182/100
1,001,865 8/1911 Lake ..... 182/100
3,847,247 11/1974 Naka ..... 182/70

*Primary Examiner*—Reinaldo P. Machado

[57] ABSTRACT

An emergency escape device for hazardous elevated structures such as offshore oil and gas drilling rigs and production platforms and the like. This device comprises a platform with an overhead support and a centrally located opening. A line is attached to the overhead support an hangs vertically through the opening. Persons may escape peril on an elevated structure by sliding down the line to safety. When not in use the line is compactly stored within the opening.

14 Claims, 3 Drawing Sheets

HAZARDOUS ELEVATED STRUCTURE EMERGENCY ESCAPE DEVICE

BACKGROUND OF THE INVENTION

This device pertains to emergency escape devices for the purpose of evacuating persons from hazardous elevated structures. Petroleum refining plants, chemical process plants, oil and gas production and drilling facilities inherently present hazardous working conditions for personnel. These hazardous conditions may become an immediate emergency should an accidental leakage of toxic fumes of flammable gas or fire occur. History has shown that it is prudent to offer personnel a convenient, fast means of escape during an emergency situation.

Standard ladders and stairways are the only means of escape available at petroleum refining and chemical plants known to this applicant. Onshore oil and gas drilling rigs, again employ standard stairways for personnel working near the ground. A cable/trolley arrangement is used as a means of escape for personnel working at substantial heights. Ladders and stairways are most often located to suit high personnel traffic flow. They do not offer the quickest means of egress and may present an additional risk to personnel during haste to evacuate. Perhaps because of the potential danger and isolation offshore oil and gas production and drilling facilities have received the most attention as related to emergency escape safety devices. These facilities are usually located on platforms which are a considerable distance above water level. Because of this height it is unsafe and impractical for personnel to jump into the water to safety. Alternative means of escape have been invented in recent years.

One such existing device is disclosed in U.S. Pat. No. 4,703,832. It consists of an exit platform to which a rigid pole is attached. The pole is stored horizontally when the device is not in use. To use this system a locking device must be released, which allows the pole to rotate to vertical whereupon personnel then slide down the pole to water level. Because of the great differential in diameter to length ratio of the pole it is subject to be easily deformed and rendered useless. The pole would have to be made of metal because of the strength/rigidity requirements of this arrangement. Metal has very good thermal conductive characteristics. Escaping personnel may not be able to use this device or be injured should the metal pole be exposed to high temperatures. An operator must stand at a remote location, some distance from the exit platform, to deploy and retrieve the pole. This remote operator location may use valuable platform deck space and become inaccessible if obstructed by equipment or supplies. Offshore platforms usually have two or three deck levels. Each deck is usually different in size with perimeters offset vertically. This system is not compact and may be difficult to locate on a platform because of offset decks and the inordinate area needed to rotate the pole from horizontal to vertical position. Another system is U.S. Pat. No. 4,202,427. It comprises an A-frame which is attached to the drilling rig or production platform. An escape capsule, which is a water-tight vessel, is suspended by wire cables from this frame. During an emergency personnel enter the capsule, then must activate a release mechanism. The frame and capsule will then pivot outboard allowing the capsule to descend by the cables, at a controlled rate of speed, to the water level. This apparatus is expensive, which may limit the number installed on a given platform, or the singular installation on a platform with few people. These capsules have limited seating capacity, which is undesirable considering the variable quantity of personnel on offshore platforms. A shortage of seating space may create panic, which may jeopardize the entire escape attempt.

SUMMARY OF THE INVENTION

This invention provides a means of evacuating personnel quickly and safely from hazardous elevated structures during an emergency situation. Accordingly several objects and advantages of my invention are listed.

This device includes an escape platform. This platform is attached to existing structure and is located conveniently for personnel use. Handrails are located at this platform perimeter to prevent personnel from falling overboard. An opening is centrally located, which is of sufficient size to allow personnel to slide through vertically (resembling a standing position).

Vertical columns are attached to and supported by the escape platform. An elevated overhead horizontal member is supported by the columns and serves as a point of support for an escape line.

The escape line is flame resistant, flexible and is rolled or coiled in the opening of the escape platform, in a stored position. This line is held in place by an end weight. This end weight is held in place, in a stored position, by a restraining cable attached to the overhead horizontal member. This restraining cable can be released by removing a cross pin.

To use this device a person has to merely pull the cross pin. This will allow the restraining cable to separate and release the end weight. The end weight will free fall, in the process uncoiling the escape line. As the escape line is paid out the end weight will come to an abrupt halt. This will create a shock which will be absorbed by a spring located between the end weight and the escape line. The end weight will then be suspended by the escape line, several feet above water. The escape line length is predetermined to suit each particular installation. The suspended end weight will stabilize, straighten, and hold the escape line in a vertical position.

After the escape line is released personnel can now depart. Personal flotation devices, located adjacent to the escape platform, will be donned by personnel. To depart, personnel will grasp the escape line with their hands then wrap their legs around the line. The person then descends, under their control and rate of speed (in much the same manner as a fireman descends a firepole). Upon reaching the end weight, the person can now jump into the water. Persons can float or swim away from the hazard to be picked up by a rescue vessel.

This device is reusable should it be undamaged during emergency use or simply used for an escape drill. To reuse, the escape line is retrieved through the opening, the restraining cable joined and pinned, then the escape line rolled back into the opening/line container.

It is the purpose of this invention to provide an immediate, safe means of evacuating personnel from a hazardous elevated offshore structure during an emergency situation.

It is the purpose of this invention to provide a simple, durable, reusable means of emergency escape.

It is the purpose of this invention to provide a means of escape which is versatile and compact, with respect to suitable installation locations.

It is the purpose of this invention to provide a means of escape, which when located at the upper level of multilevel structures can be used by an unlimited number of persons from different levels simultaneously.

It is the purpose of this invention to provide an emergency means of escape from elevated structures which is practical and inexpensive, thus promoting the number of and use of these life saving devices.

BRIEF DESCRIPTION OF THE DRAWINGS

Pictorial information along with detailed descriptions of the device and its parts are included for a clear understanding. The parts drawings and description have corresponding numbers.

DETAILED DESCRIPTION OF THE DRAWINGS

Figure 1:
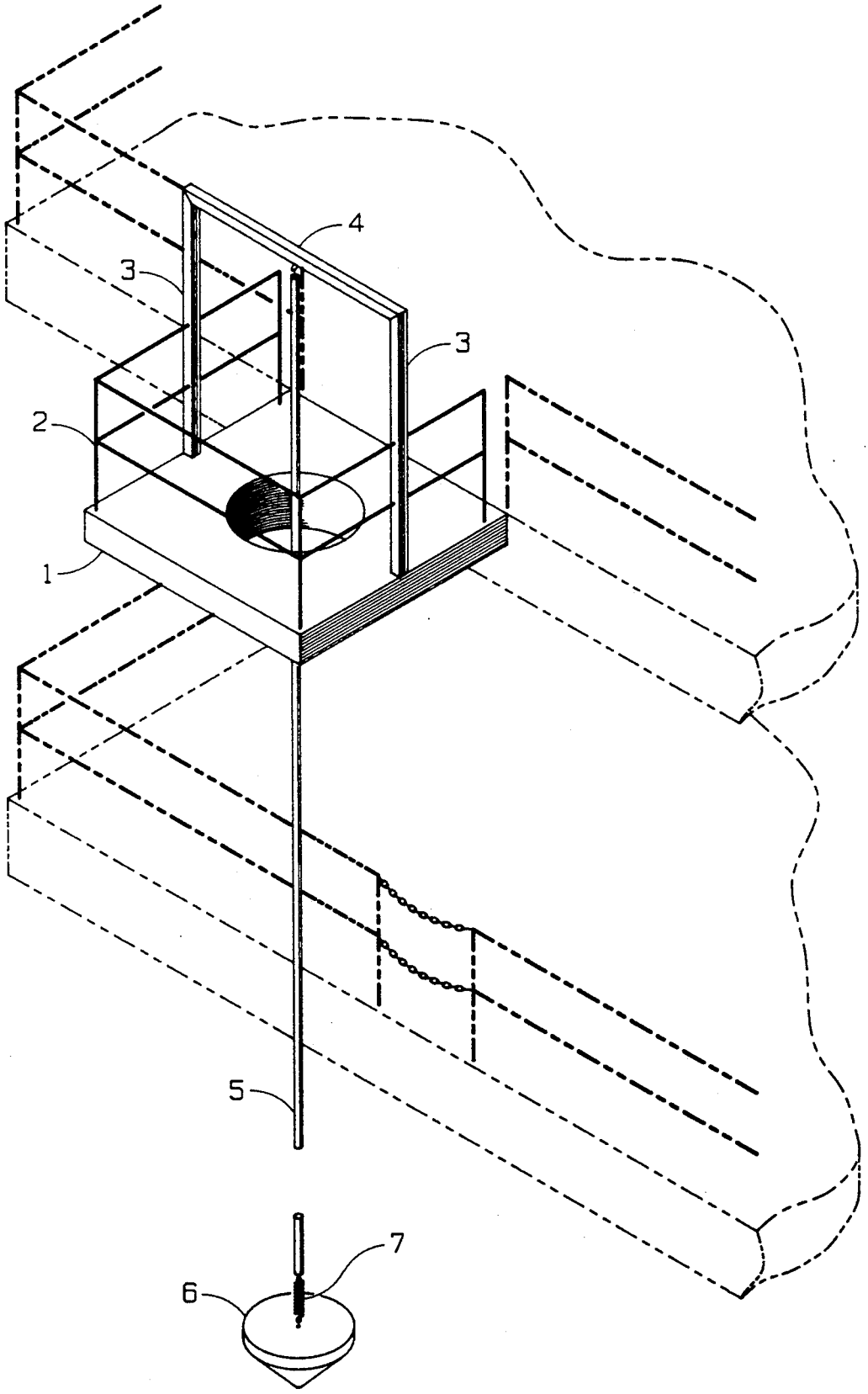
FIG. 1 is an isometric view of the device, in a released position, attached to a multilevel structure.

FIG. 1 is an isometric view of the invention. The escape platform 1, which is an extension of the existing deck, is shown attached to the upper deck of an elevated structure. Elevated hazardous offshore structures typically have two deck levels, the uppermost deck varying in heights of 30 feet to 80 feet above water level. The lower deck of these dangerous facilities is usually positioned 10 feet to 20 feet below the upper deck. An escape line 5 is shown "broken", the actual proportioned length would not be practical to illustrate.

The escape platform 1 may be suitably sized and located to position the escape line 5 within reach of personnel at the lower deck level. Thus personnel may access this singular device without ascending or descending deck levels. And the requirement of a device at each level eliminated.

Figure 2:
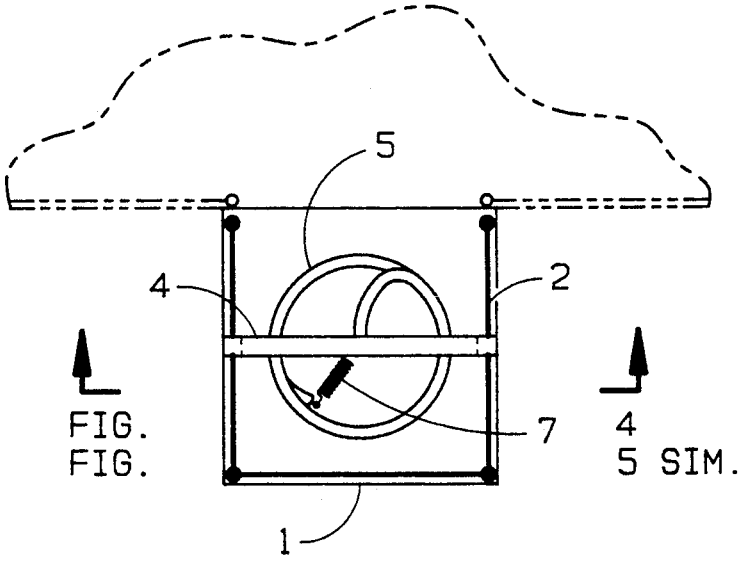
FIG. 2 is a plan view of the device in a stored position.
Figure 3:
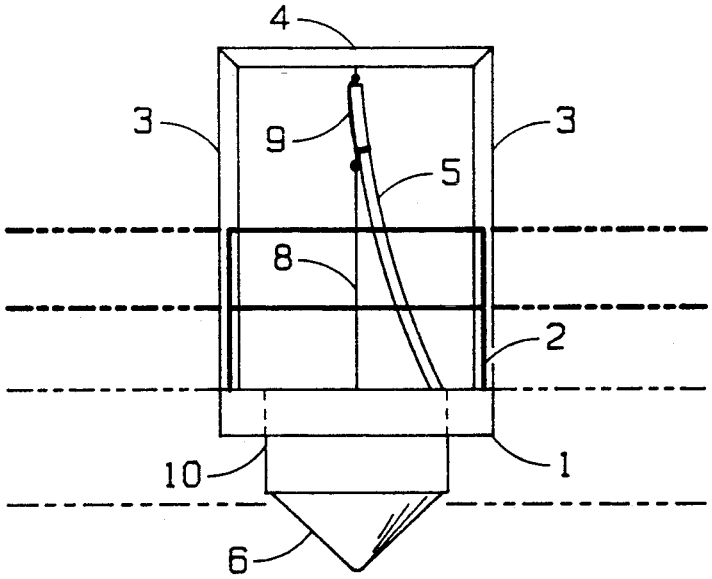
FIG. 3 is an elevation of the device in a stored position.

FIGS. 2 and 3, respectively, are a plan view and elevation of the invention. Both views illustrate the simplicity and compactness of the device in a stored, unused arrangement. The plan view, FIG. 2, shows the escape platform 1 being square and the opening/storage container 10 centered. However this is only one typical design. The platform may be rectangular and the opening may be somewhat centered, depending on the particular design requirements.

Figure 4:
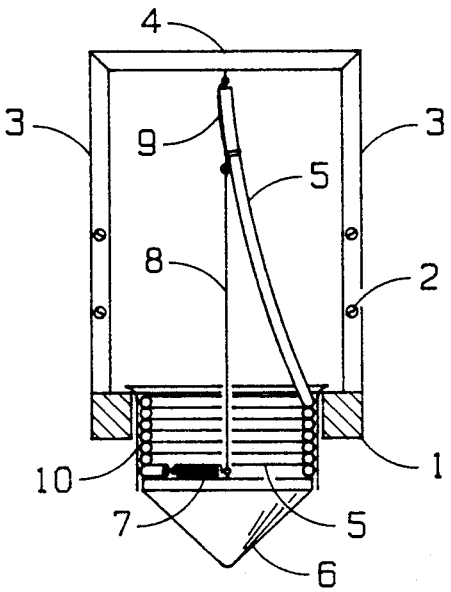
FIG. 4 is a cross 10 sectional view of the device in the stored position.

FIG. 4 is a cross sectional view of the device, in a stored position. The escape platform 1 is attached to and supported by an existing elevated platform deck. The escape platform 1 has a centrally located opening into which a storage container 10 is fitted and attached. The combination opening/storage container 10 serves a dual purpose. The first, described in this section, is a container which houses the escape line 5 and an end weight 6. The escape line 5 is compactly rolled or coiled inside the container. The end weight 6 is supported vertically by the use of a separable restraining cable 8 and 9. The end weight 6 is supported laterally by the storage container 10. The end weight 6, in this configuration, supports the escape line 5 vertically.

The restraining cable 8 and 9 comprises an upper 9 and lower 8 section joined by a removable pin. The lower section 8 is attached to the end weight 6. The upper section 9 is attached to and supported by an overhead horizontal member/frame 4. This overhead horizontal member/frame 4 is supported by vertical columns 3. This frame arrangement is somewhat "U" shaped. The vertical columns 3 are attached to and supported by the deck extension/escape platform 1.

Figure 5:
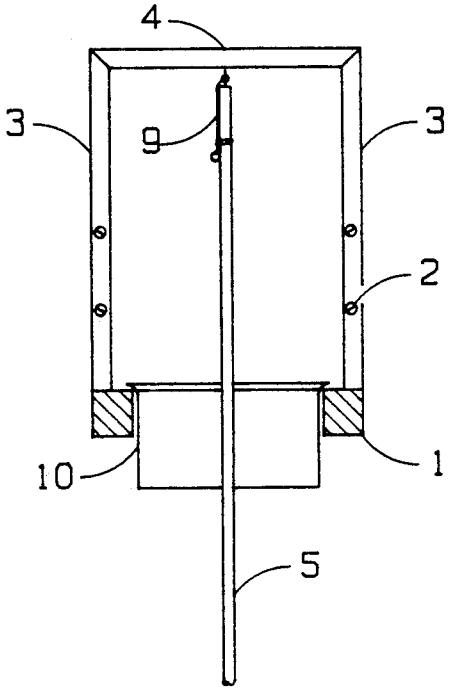
FIG. 5 is a cross sectional view of the device in a released position.
Figure 5:
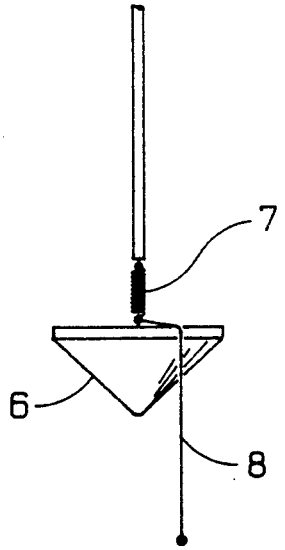

FIG. 5 is a cross sectional view illustrating the invention in the escape or deployed arrangement. Escaping personnel will be contained within the escape platform 1 and prevented from falling overboard by horizontal rails 2 and vertical posts. The second purpose of the combination opening/storage container 10 is to form an opening through which personnel slide through when descending the escape line 5.

The escape line 5 is again shown "broken", for the same previously stated reason. In this view the escape line 5 is attached to and supported by the horizontal member 4.

At the bottom of the escape line 5 is a shock absorber 7. This impact dampening device 7 supports the end weight 6 while deployed. This devise absorbs the shock of the free falling end weight 6 when the restraining cable 8 and 9 is separated and the escape line 5 has paid out.

The end weight 6 will maintain the escape line 5 substantially vertical and further serve to stabilize the line during wind or wave influence. The end weight 6 is also a personnel stop and departure reference. The restraining cable lower section 8 is shown separated from the upper section 9 and hanging freely from the end weight 6. The escape line 5 is used by escaping personnel to slide down, away from peril, to safety. This line is of ergonomic design, that is to say it is sized to maximize the gripping/surface area of the average person. The escape line 5 is also flexible and fire and heat resistant. This line has some abrasive quality, which aids personnel in a controlled descent.

Additional obvious qualities are; Simplicity, the system is made up of few parts and there are no moving parts. Reliability, because there are no moving parts there is no mechanism which can fail to operate. Compactness, in a stored position the device requires an approximate area of $6' \times 6' \times 12'$ vertical. Economy, the cost of this device is approximately 50% of the comparable rigid pole apparatus. At this point the need and value of this described life saving devise should be evident.

I claim:

1. An escape device for evacuating an unlimited number of persons, several persons simultaneously, from hazardous elevated offshore structures comprising:

a. an escape platform having a centrally located opening, personnel containment means, a plurality of vertical columns, and an overhead horizontal member;

b. an escape line means connected to and supported at one end by said overhead horizontal member;

c. an end weight attached to opposite end of said escape line; and d. a restraining cable connected to said overhead member and said end weight.

2. The device of claim 1, wherein said opening further comprises a storage container means for said escape line, said storage container means being secured to said escape platform, and being of sufficient size for personnel passage.

3. The device of claim 1, wherein said personnel containment means further comprises a plurality of horizontal rails connected to said vertical columns and a plurality of vertical posts.

4. The device of claim 1, wherein said vertical columns are supported at the lower extremity by said escape platform, and support said overhead horizontal member, said overhead horizontal member forms support means for the upper end of said escape line and restraining cable.

5. The device of claim 1, wherein said escape line means comprises a flexible member which is flame resistant and of sufficient length and strength to effect escape requirements, including a friction enhanced external surface which aids personnel in controlled descent.

6. The device of claim 5, further comprising a shock absorbing means at the lower end of said escape line said shock absorbing means is attached to said end weight and composes a support means for said end weight when in a released position.

7. The device of claim 1, wherein said end weight comprises a closed hollow cell being conically shaped and partially filled with a dense material for weight means, and which has sufficient reserve void to provide buoyant means in a deployed position, said end weight being attached to lower end of said escape line and said restraining cable to stabilize said escape line when deployed, said end weight further forming a support means for said escape line in a stored position.

8. The device of claim 1, wherein said restraining cable provides support means for said end weight, said restraining cable comprising an upper and a lower section, said upper section being fastened to said overhead horizontal member and joined at its lower end to said lower section upper end by removable pin means, said lower section being fastened to and supporting said end weight in a stored arrangement.

9. An emergency escape device intended to aid personnel fleeing harm from a raised dangerous facility having an uppermost deck level, said device comprising:

a. a planar escape platform including an opening, vertical columns connected by an elevated horizontal member;

b. a semi-rigid escape line having an upper and lower end, said upper end being fastened to said elevated horizontal member;

c. a floatable end weight secured to the lower end of said escape line; and d. a dual-sectioned restraining cable which suspends said end weight within said opening.

10. The apparatus of claim 9, wherein said escape platform includes personnel-confining means, and is attached to the uppermost deck level of said dangerous facility, said opening additionally forms a storage means for said escape line, said vertical columns and said horizontal member form inverted "U"-shaped support means for said escape line and said restraining cable.

11. The apparatus of claim 9, wherein said escape line is of ergonomic design, and sufficient length to extend from said uppermost deck level to water level, and wherein said escape line further comprises attachment and shock absorbing means at the lower end for said end weight in a deployed position.

12. The apparatus of claim 9, wherein said end weight is marginally smaller in diameter than said opening, is semi-rigid, conically shaped, water-tight, and comprises a support means for said escape line during storage.

13. The apparatus of claim 9, wherein said restraining cable comprises first and second elements, the first element attached to said elevated horizontal member and joined to the second element by a displaceable pin means, and wherein said end weight is attached to and supported by the second element in a stored arrangement.

14. An emergency escape device which can be used by several people simultaneously to abandon elevated offshore platforms and drilling rigs during an emergency situation, comprising:

a. a deck extension means with personnel passage opening, escape line storage means, overhead frame, and integral personnel containment means;

b. a flame resistant, flexible, abrasive, escape line means which hangs vertically from said overhead frame through said opening extending from facility top deck to water level, said escape line means including impact dampening means and end weight means; and c. a separable restraining cable means attached to said overhead frame, said restraining cable supporting said end weight in a stored position.

* * * * *